United States Patent [19]

Panzke

[11] Patent Number: 5,033,556

[45] Date of Patent: Jul. 23, 1991

[54] METHOD AND APPARATUS FOR HORIZONTAL DRILLING

[75] Inventor: Rolf Panzke, Balge, Fed. Rep. of Germany

[73] Assignee: Baker Hughes Incorporated, Houston, Tex.

[21] Appl. No.: 472,725

[22] Filed: Jan. 31, 1990

[30] Foreign Application Priority Data

Feb. 1, 1989 [DE] Fed. Rep. of Germany ..... 3902868

[51] Int. Cl.[5] ..... E21B 7/08

[52] U.S. Cl. ..... 175/62; 175/171; 175/257

[58] Field of Search ..... 175/22, 23, 73, 75, 175/171, 173, 257, 62, 61; 166/71

[56] References Cited

U.S. PATENT DOCUMENTS 4,176,985 12/1979 Cherrington ..... 405/184
4,492,276 11/1985 Kamp ..... 175/75 X
4,667,751 5/1987 Geczy et al. ..... 175/61

*Primary Examiner*—William P. Neuder
*Attorney, Agent, or Firm*—Michael Polacek

[57] ABSTRACT

The present invention comprises a novel method and apparatus for forming a perimeter lined, generally horizontally directed drill hole in a variety of soil formations. More particularly, the present invention discloses a method and apparatus for horizontal drilling which allows for the preparation of reinforced drill holes of a small diameter and precise heading by the use of a directed drilling tool seated within a mantle tube and the simultaneous advancement into various soil formations of this combination.

19 Claims, 3 Drawing Sheets

METHOD AND APPARATUS FOR HORIZONTAL DRILLING

BACKGROUND OF THE INVENTION

The present invention pertains to a novel method and apparatus used to establish a perimeter lined, generally horizontally directed drill hole in a variety of soil formations.

In a known method of this type, see, e.g., journal "Erdöl, Erdgas, Kohle", Vol 103, No. 12, pp. 531–534, the drill hole is advanced by the use of a directed drilling tool connected to a drill string by an extender section. A mantle tube is tracked along the drill string and the drill hole originally bored by the rotary drill bit of the directed drilling tool is re-bored. As soon as the front end of the mantle tube connects with the directed drilling tool, a section of the drill hole is drilled ahead with the directed drilling tool and then the mantle tube is tracked again. In this manner, both the drill string, including the directed drilling tool, and the mantle linkage are alternately advanced along an imaginary, predetermined line defined as the drill hole axis.

This method of alternatively tracking the mantle tube requires considerable drilling effort due to the re-drilling and produces drill holes with a diameter considerably larger than the rated diameter of the rotary drill bit. Furthermore, the accuracy of this drill head leaves much to be desired since a directed drill tool with an unstabilized bent housing including a deep hole motor is braced directly against the drill hole wall. Particularly in soft formations, e.g. sandy soils, the direction of the advance is quite imprecise and frequent direction corrections are needed to keep the advance of the drill hole near the desired, specified line. Additionally, the removal of fines becomes increasingly difficult as the distance of the drill bit from the front end of the mantle tube increases. These problems are magnified in soft formations and in formations with heavy ground water volume.

SUMMARY OF THE INVENTION

The present invention discloses a method and apparatus for horizontal drilling which allows for the preparation of reinforced drill holes of a small diameter and precise heading with a reduction in the work effort and therefore the associated costs.

Pursuant to the method disclosed by the present invention, only the rotary drill bit determines the drill hole diameter. The mantle tube directly follows the rotary drill bit within the contour of the drill hole bored by the rotary drill bit and it also forms a wall surface on which the outer housing of the directed drilling tool can be precisely braced. The directed drilling tool can also be completely withdrawn from the drilled formation, except for its rotary drill bit and the drill pipeline.

The directed drilling tool, the accompanying drill string, and the mantle tube form a unit moving simultaneously through the formation. The directed drilling tool guides the front end of the mantle tube which in turn forms a precise guide for the directed drilling tool and encapsulates it except for the tool's rotary drill bit. The mantle tube also forms a solid guide surface on its outside facilitating the removal of fines.

The drilling apparatus disclosed herein is of an extremely simple design and one that allows for the preparation of drill holes with an exceptionally precise heading since the directed drilling tool no longer braces against a perhaps insecure drill hole wall or a wall damaged by wash-outs. A navigational drilling tool can be used to a particular advantage as a directed drilling tool since its stabilizers provide additional drilling accuracy by further guiding the outer housing.

BRIEF DESCRIPTION OF THE DRAWING

A sample design of the present invention is illustrated in the following figure.

DETAILED DESCRIPTION OF THE PREFERRED EMBODIMENTS

Figure 1:
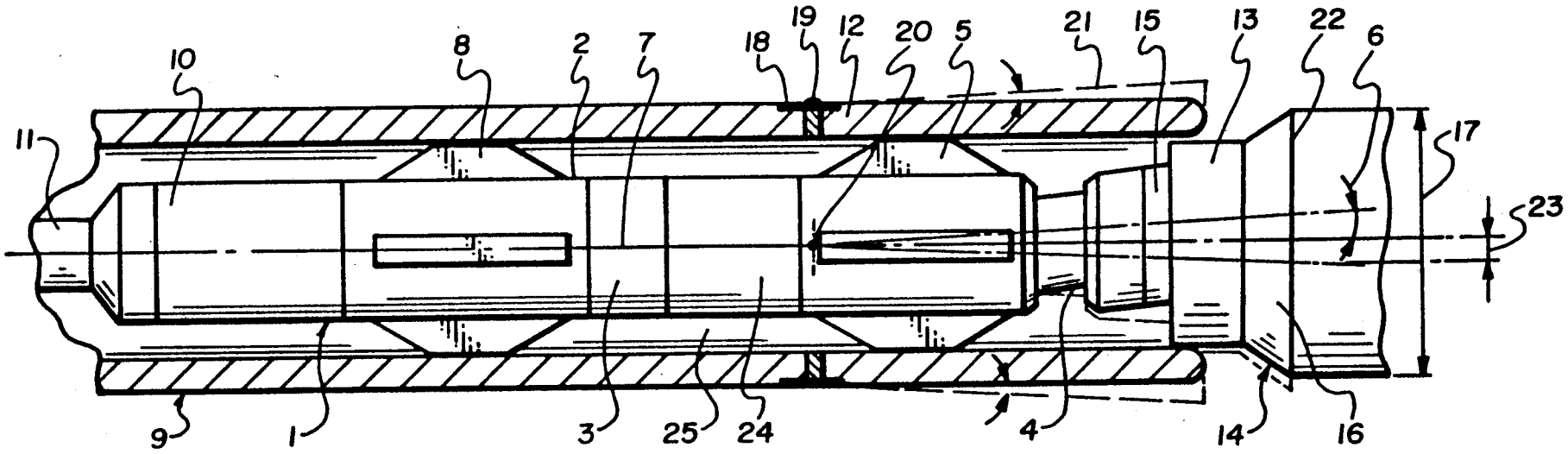
FIG. 1 is a schematic, partially cut-away side view of a horizontal drilling apparatus as disclosed by the present invention.

With reference to FIG. 1, the apparatus disclosed herein is comprised of a directed drilling tool 1, designed in the present example as a navigational drilling tool, including a tubular outer housing 2 in which a deep hole motor 3 is placed. The motor's preferable design is that of a turbine driven by the hole flushing flow or of a Moineau motor driven by the same. The deep hole motor 3 drives a bit shaft 4 protruding from the front end of the outer housing 2. The shaft 4 is seated in the front portion of outer housing 2 at the level of a front stabilizer 5 and its axis is aligned at an angle 6 to the middle axis 7 of the rearward main section of the outer housing 2 of the directed drilling tool 1.

The outer housing 2 also has a rearward stabilizer 8 at its rearward main section. The stabilizers 5 and 8 are formed by stabilizer wings or ribs and brace the outer housing 2 of the directed drilling tool 1 against the inside of mantle tube 9. At its rear end, the outer housing 2 of the directed drilling tool 1 is linked by a transition piece 10 to a drill string 11. The drill string's aboveground end (not illustrated) is advanced by known advancing and pushing elements (also not illustrated). The drill string can be set in rotary motion and is braceable in aligned positions. Suitable drive and pusher elements are known to any technician ordinarily skilled in the drilling art.

The front end of the mantle tube 9 is designed as a separate part 12 which is flexibly mounted to the main section of the mantle tube 9. This front part 12 meshes at its front edge with the guide section 13 of a rotary drill bit 14. The guide section 13 of the rotary drill bit 14 is formed by a cylindrical seal and a guide surface on which the front edge region of the front part 12 of the mantle tube 9 is seated, preferably forming a seal therebetween. The rotary drill bit 14 is positioned via linkage 15 and extendable locking elements (not illustrated) on the front end of the bit shaft 4 and the bit 14 is temporarily decoupleable from the bit shaft 4. The rotary drill bit 14 or, more particularly, its cutting section 16 has a rated diameter 17 which is equal to or slightly greater than the outer diameter of the mantle tube 9.

Figure 2:
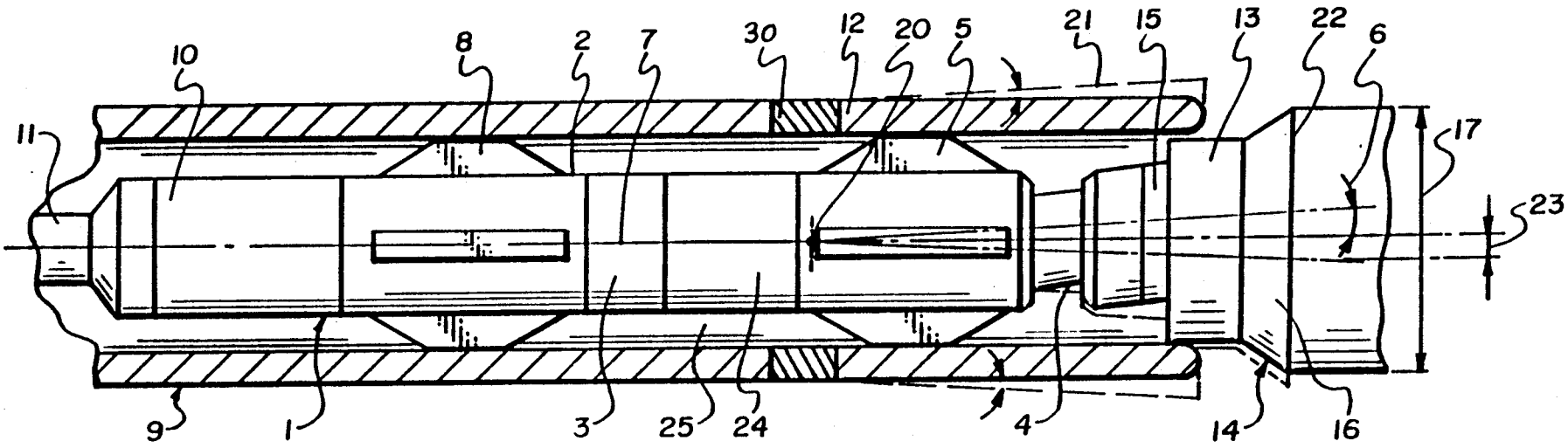
FIG. 2 is a schematic, cut-away side view of the mantle tube flexible transition region.
Figure 3:
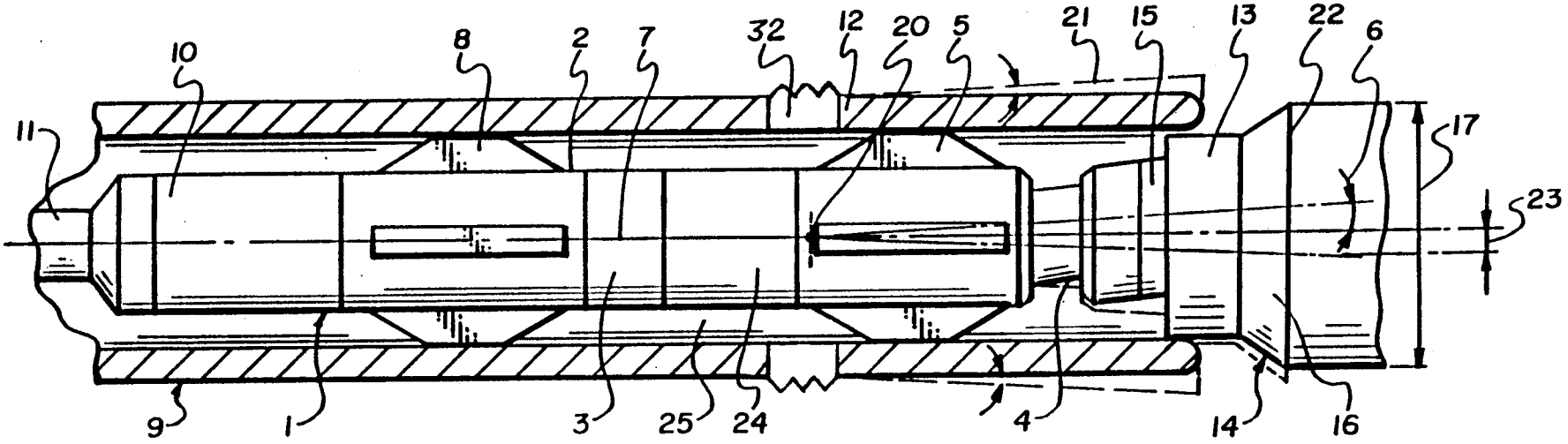
FIG. 3 is a schematic, cut-away side view of one embodiment of the mantle tube flexible transition region shown in FIG. 2.

The front end of the mantle tube 9 is designed as a separate, moveable part 12 and it is flexibly linked via a pipe joint to the drill string connected main portion of the mantle tube 9. The joint 18 in the present example is designed as a cross-section joint. The cross-section joint shown is sealed by an outer perimeter gasket 19. Instead of a cross-section joint, the pipe joint could also be made of a flexible transition region 30 of mantle tube 9, as shown in FIG. 2. The flexible transition region 30 could, in turn, be comprised of a corrugated pipe 32, as shown in FIG. 3 section, a section of flexuraly elastic material (not shown), or even by a section (also not shown) of the mantle tube 9 with a reduced resistance moment compared to the neighboring regions of the mantle tube 9.

The angle 6 between the axis of the bit shaft 4 and the middle axis 7 of the outer tube 2 of the directed drilling tool 1 is formed by a bend in the front portion of the outer housing 2 located in the region of the front stabilizer 5. The bend point 20 of the outer housing 2 is located opposite the drill bit 14 and behind the stabilizer 5 while at the same time being located in or near the joint plane of the pipe joint 18 of the mantle tube 9. The bend angle corresponding to angle 6 in this example lies in an imagined plane perpendicular to the plane of FIG. 1 and running through the middle axis 7 of the mantle tube 9.

Accordingly, the front part 12 of the mantle tube 9, during any relative rotary motion between the front part 12 and section 13 of the mantle tube 9 and the directed drilling tool 1, respectively, can copy the motions of the front portion of the directed drilling tool 1. The mantle tube's 9 front part's 12 axis will then follow and form the outline of a cone whose peak coincides with the bend point 20 of the outer housing 2 of the directed drilling tool 1. This cone is illustrated by the dashed line 21 around the front part 12 of the mantle tube 9 and the offset or eccentricity 23 of the motion of the rotary drill bit 14 in its cutting plane.

In order to prevent wash-outs of the drill hole in soft formations due to strong hole-flushing flow, such as is needed for driving a hydraulic deep hole motor 3, a portion of the hole flushing flow can be diverted through a flow-dependent bypass valve 24 into the annulus 25 between the outer housing 2 and the mantle tube 9. The bypass valve 24 is provided downstream in the outer housing 2 in such a position that only a correspondingly reduced portion of the hole-flushing flow volume per time unit will pass by the rotary drill bit 14 and flow over into the drill hole.

In order to form a mostly horizontally aligned drill hole, yet one which runs, at least in sections, at a notable angle downward and/or upward, and one which is reinforced at its perimeter by a mantle tube 9, the directed drilling tool 1 and mantle tube 9 are set in rotary motion and tracked with a guidance system. The rotary direction of the mantle tube 9 and the directed drilling tool 1 can be the same, but are preferably in opposite directions. Slow rotation of the directed drilling tool 1 ensures a straight drilling direction despite the bending of outer housing 2 whereby an additional clearing effect is provided by the eccentricity 23. The rotary motion of the mantle tube 9 is used to reduce the resistance to the advancing motion of the mantle tube 9 into the formation. Accordingly, the speed of the rotary motion of the mantle tube 9 can differ from that of the directed drilling tool 1 and can be set so as to minimize any resistance.

If the continued drilling of the drill hole requires an angled drilling step, then the directed drilling tool 1 can be stopped via the drive and pusher elements and the drill string in an orientation of the outer housing 2 which corresponds to the required continuing directional profile of the drill hole. The particular position of the rotary drill bit 14 or of the directed drilling tool 1 in the drill hole can be determined continuously or at intervals by suitable sensors so that a precise drill-hole profile can be directed through alternating the stoppage and rotation of the directed drilling tool 1.

The linkage 15 between the bit shaft 4 and the rotary drill bit 14 makes it possible to move the directed drill tool 1 out of the drill hole while the mantle tube 9 remains immersed, e.g., for inspection and maintenance work. It is also possible to replace a directed drilling tool 1 as shown with one without a bend in the outer housing 2 and the correspondingly angled profile of the axis of the bit shaft 4 with respect to the middle axis 7 of the outer housing 2 so that a straight, longer hole can be drilled and one whose diameter is governed solely by the rated diameter of the rotary drill bit 14.

In the foregoing specification, this invention has been described with reference to specific exemplary embodiments thereof. It will be evident, however, that various modifications and changes may be made thereunto without departing from the broader spirit and scope of the invention as set forth in the appended claims. The specification and drawing included here are, accordingly, to be regarded in an illustrative rather than in a restrictive sense.

What is claimed is:

1. A drilling apparatus comprising a directed drilling tool, said tool including a tubular outer housing with a front and rear end and including a front and rear stabilizer, a drill bit mounted to a bit shaft protruding from the front end of said housing, said bit having a guide section associated therewith, and a deep hole motor for driving said drill bit via said bit shaft, said housing connectable to a drill string at said housing's rear end, and further including a mantle tube, said mantle tube including a main portion and a front part which is flexibly connected to said main portion, said directed drilling tool being at least partially located in and braced within said mantle tube main portion by said rear stabilizer and within said mantle tube front part by said front stabilizer with the guide section proximate with the front part of said mantle tube.

2. The drilling apparatus of claim 1 wherein the front part of said mantle tube engages the guide section thereby forming a substantial seal between said mantle tube front part and said drill bit guide section.

3. The drilling apparatus of claim 1 wherein the flexible connection between the front part of said mantle tube and the main portion of said mantle tube is a pipe joint.

4. The drilling apparatus of claim 3 wherein said pipe joint is designed as a cross-section joint.

5. The drilling apparatus of claim 4 wherein said cross-section joint is sealed by an outer revolving seal.

6. The drilling apparatus of claim 3 wherein said pipe joint is formed by a flexible transition region of said mantle tube.

7. The drilling apparatus of claim 6 wherein said transition region is formed by a corrugated pipe section.

8. The drilling apparatus of claim 6 wherein said transition region is formed by a section of flexuraly elastic material.

9. The drilling apparatus of claim 6 wherein said transition region has a reduced resistance moment compared to neighboring regions of said mantle tube.

10. The drilling apparatus of claim 1 wherein the mantle tube has an outer diameter which is less than or equal to the rated diameter of the drill bit cutting section.

11. The drilling apparatus of claim 3 wherein the drilling tool comprises a navigational drilling tool with a bend joint in said outer housing, wherein said pipe joint forms a joint plane and said bend joint is located in or near the joint plane formed by the pipe joint of said mantle tube.

12. The drilling apparatus of claim 1 wherein the guide section includes a cylindrical gasket and a guide surface and the front part of said mantle tube includes a front edge region which is seated on said gasket and guide surface.

13. The drilling apparatus of claim 1 wherein the drill bit is decoupleably linked to said bit shaft protruding from the front end of said outer housing by a hinged locking element.

14. The drilling apparatus of claim 1 wherein the deep hole motor is designed as a drill flush-actuated motor and the outer housing of the directed drilling tool is provided with a volume-related bypass valve for diverting a portion of the drill hole flushing flow.

15. A method for establishing a perimeter lined, generally horizontally aligned drill hole in a soil formation comprising the steps of:

providing a directed drilling tool including a tubular outer housing with a front and rear end and a front and rear stabilizer, a drill bit mounted to a bit shaft protruding from the front end of said housing, said bit having a guide section associated therewith, a deep hole motor for driving said drill bit via said bit shaft, and a mantle tube including a main portion and a front part which is flexibly connected to said main portion;

at least partially locating and bracing said directed drilling tool within said mantle tube main portion by said rear stabilizer and within said mantle tube front portion by said front stabilizer; aligning said guide section with the front part of said mantle tube; and simultaneously advancing said drilling tool with said mantle tube while rotating said drill bit with said deep hole motor.

16. The method of claim 15 wherein the mantle tube is tracked in the drill hole with a guidance system.

17. The method of claim 15 wherein the mantle tube is rotated during its advance.

18. The method of claim 15 wherein a navigation drilling tool is used as the directed drilling tool and wherein said drilling tool is intermittently rotated.

19. The method of claim 15 wherein the directed drilling tool and the mantle tube are both rotated and in directions opposite to each other.

* * * * *